US007074052B1

(12) United States Patent
Ni et al.

(10) Patent No.: US 7,074,052 B1
(45) Date of Patent: Jul. 11, 2006

(54) USB DEVICE WITH CASE HAVING INTEGRATED PLUG SHELL

(75) Inventors: Jim Ni, San Jose, CA (US); Ren-Kang Chou, Fremont, CA (US)

(73) Assignee: Super Talent Electronics, Inc., San Jose, CA (US)

( * ) Notice: Subject to any disclaimer, the term of this patent is extended or adjusted under 35 U.S.C. 154(b) by 0 days.

(21) Appl. No.: 11/128,054

(22) Filed: May 11, 2005

(51) Int. Cl.
*H01R 12/00* (2006.01)

(52) U.S. Cl. ..... 439/76.1; 439/951; 174/261; 361/752; 29/830; 29/876

(58) Field of Classification Search ..... 439/59, 439/61, 64, 76.1, 79, 660, 951; 174/255, 174/261; 361/752; 29/830, 832, 842, 876
See application file for complete search history.

(56) References Cited

U.S. PATENT DOCUMENTS 5,941,725 A * 8/1999 Brennan et al. ..... 439/357
6,036,544 A * 3/2000 Brunker et al. ..... 439/607
6,309,255 B1 10/2001 Yu
6,618,243 B1 9/2003 Tirosh
6,671,808 B1 * 12/2003 Abbott et al. ..... 726/4
6,744,634 B1 6/2004 Yen
6,854,984 B1 * 2/2005 Lee et al. ..... 439/79
6,944,028 B1 * 9/2005 Yu et al. ..... 361/737
2003/0100203 A1 5/2003 Yen
2005/0085129 A1 * 4/2005 Chiou et al. ..... 439/607

* cited by examiner

*Primary Examiner*—James R. Harvey
(74) *Attorney, Agent, or Firm*—Bever, Hoffman & Harms, LLP; Patrick T. Bever

(57) ABSTRACT

A Universal-Serial-Bus (USB) device includes a PCBA mounted inside a plastic housing, which in turn is inserted or otherwise secured inside an outer case. The case is made of metal or hard plastic, and includes a handle portion that is integrally connected to a plug shell. The plug shell extends over a plug portion of the PCBA, which is mounted on a corresponding substrate portion of the housing, forming a structural arrangement similar to a conventional male USB connector plug, but without having the plug shell soldered to the PCBA. The case is, for example, sheet metal that is folded into a frame-like box for receiving the housing. The handle portion engages a cover portion of the housing such that plastic panels are exposed through openings formed in the metal casing walls.

16 Claims, 11 Drawing Sheets

USB DEVICE WITH CASE HAVING INTEGRATED PLUG SHELL

FIELD OF THE INVENTION

This invention relates to portable electronic devices, and more particularly to portable electronic devices that utilize the Universal-Serial-Bus (USB) specification.

BACKGROUND OF THE INVENTION

Rapid advances in technology in several areas have converged to enable small, portable memory cards with vast capacities. Flash memory technologies such as those using electrically-erasable programmable read-only memory (EEPROM) have produced chips storing 128 M-Bytes or more. Small flash-memory cards have been designed that have a connector that can plug into a specialized reader, such as for compact-flash, secure-digital, memory stick, or other standardized formats.

More recently, flash memory cards are being sold that contain a USB connector. Such USB-flash memory cards do not require a specialized reader but can be plugged into a USB connector on a host system, such as a personal computer (PC). These USB-flash memory cards can be used in place of floppy disks. A USB-flash card can have a capacity of more than ten floppy disks in an area not much larger than a large postage stamp.

FIG. 15(A) shows a prior-art flash-memory card with a conventional male USB connector. Flash memory chip 12 may be a 128 Mega-byte non-volatile chip or may have some other capacity. Controller chip 14 contains a flash-memory controller that generates signals to access memory locations within flash memory chip 12. Controller chip 14 also contains a USB interface controller that serially transfers data to and from flash memory chip 12 over a USB connection.

Male USB connector 20 may be mounted on board 10, which is a small circuit board with chips 12, 14 mounted thereon. Multi-layer printed-circuit board (PCB) technology can be used for board 10. A plastic case (not shown) can surround board 10.

Male USB connector 20 contains a small connector substrate 16, which is often white ceramic, black rigid plastic, or another sturdy substrate. Connector substrate 16 has four or more metal contacts 18 formed thereon. Metal contacts 18 carry the USB signals generated or received by controller chip 14. USB signals include power, ground, and serial differential data D+, D−.

Male USB connector 20 contains a metal case (plug shell) 11 that wraps around connector substrate 16. The plug shell touches connector substrate 16 on three of the sides of connector substrate 16. The top side of connector substrate 16, holding metal contacts 18, has a large gap to the top of the plug shell. On the top and bottom of this metal wrap are formed holes 15. USB connector 20 is a type-A USB connector.

FIG. 15(B) shows a female USB socket connector 22. Female USB socket connector 22 can be an integral part of a PC or other host system, or can be connected by cable 21 to such a host system. Another connector substrate 26 contains four metal contacts 28 that make electrical contact with the four metal contacts 18 of the male USB connector 20 of FIG. 15(A). Connector substrate 26 is wrapped by a metal case, but small gaps are between the metal case and connector substrate 26 on the lower three sides.

Locking is provided by metal springs 24 in the top and bottom of the metal plug shell. When male USB connector 20 of FIG. 15(A) is flipped over and inserted into Female USB socket connector 22 of FIG. 15(B), metal springs 24 lock into holes 15 of male USB connector 20.

FIGS. 16(A) and 16(B) are cross-sections highlighting connections between male and female USB connectors. Female USB socket connector 22 is on the left while male USB connector 20 is being inserted from the right. Male USB connector 20 is flipped over relative to the view of FIG. 15(A). Metal contacts 18 are formed on the lower surface of connector substrate 16 on male USB connector 20, while metal contacts 28 are formed on the upper surface of connector substrate 26 on female USB socket connector 22. Thus the metal contacts face one another to allow for electrical contact when male USB connector 20 is inserted into female USB socket connector 22 as shown in FIG. 16(B).

Metal springs 24 formed on the metal case surrounding connector substrate 26 on Female USB socket connector 22 fit into holes on the plug shell of male USB connector 20. This helps to lock the connectors together.

A problem associated with the production of conventional male USB devices that utilize standard male USB plug connectors typically require lead-based soldering methods to attach the standard plug structure (e.g., substrate 16 and plug shell 11) to circuit board 10. Lead (Pb) is recognized as a hazardous material, and may at some point in time be banned from use. Lead-free soldering requires higher peak temperatures (about 240° C.) that can shrink or warp plastic substrates 16, thereby making such conventional USB plug connector structures unsuitable for lead-free fabrication processes.

FIG. 17 shows a prior-art USB flash memory card using a low-profile USB connector that avoids the need for attaching a separate substrate and plug shell to a circuit board by integrating male USB connector 30 with board 32, and by omitting the plug shell entirely. Board 32 is a PCB that has flash memory chip 12 and controller chip 14 mounted thereon. Board 32 is extended to include male USB connector 30, which has metal contacts 38 formed on end 36 of board 32. The width and thickness of board 32 at end 36 containing male USB connector 30 is designed to approximately match that of connector substrate 16 of FIG. 15(A). Plastic case 34 can enclose board 32 but have an opening for metal contacts 38. Plastic case 34 can cover the bottom and sides of male USB connector 30 up to end 36 to emulate potions of the metal case of the male USB connector of FIG. 15(A).

FIGS. 18(A) and 18(B) show cross-sections of the prior-art lower-profile USB connector being inserted into a standard Female USB connector. Board 32 that has male USB connector 30 formed on end 36 is flipped over from the view shown in FIG. 17, and end 36 is inserted into female USB socket connector 22 from the right side.

Metal contacts 38 are located on the lower surface of male USB connector 30. Plastic case 34 has an opening on the lower surface of male USB connector 30 to expose the metal contacts so they can make electrical connection with metal contacts 28 on the upper surface of connector substrate 26 of Female USB socket connector 22 when inserted as shown in FIG. 18(B).

Plastic case 34 helps to fill the gaps between board 32 and the top edge of the metal case of Female USB socket connector 22. However, no holes are provided in plastic case 34, so metal springs 24 are pushed up slightly when male USB connector 30 is inserted into Female USB socket connector 22. Plastic case 34 is also formed along the thin edges of board 32 and helps to fill in the gaps between connector substrate 26 and the sides of the metal case of Female USB socket connector 22 that are above and below the plane of FIG. 18(B).

While USB connector 30 can be less expensive and smaller than the standard USB connector and avoids the need for plug shell, it can have the undesirable characteristic of wobbling in the female USB connector socket, and exposes contacts 38 to damage.

What is needed is a USB device having a male USB connector plug that avoids the need for soldering the plug shell to the circuit board. What is also needed is a method for manufacturing such USB devices.

SUMMARY OF THE INVENTION

The present invention is directed to a USB device in which the plug shell is integrally connected to a case structure that mounts over a printed circuit board assembly (PCBA), thereby avoiding the need for soldering the plug shell to the PCBA as in conventional manufacturing methods, thus facilitating a lead-free structure.

In accordance with an embodiment of the present invention, the PCBA is mounted inside of a plastic housing, which in turn is mounted inside (coupled to) the case. The PCBA includes a printed circuit board (PCB) a PCB body (rear) section and a PCB plug (front) section, metal contacts disposed on the PCB plug section, and USB-compatible integrated circuits (ICs) mounted on the PCB body section. The plastic housing includes a cover portion mounted over the PCB body section, and a plug substrate portion integrally connected to and extending from the cover portion. The PCB plug section is fixedly attached to the plug substrate portion such that the plug substrate portion covers the lower surface of the PCB plug section, and the upper surface of the PCB plug section is exposed above the plug substrate portion. The case includes a handle portion fixedly secured around the cover portion of the plastic housing, and the plug shell, which is integrally connected to and extends from the handle portion such that a lower wall of the plug shell contacts a lower surface of the plug substrate portion, and an upper wall of the plug shell is positioned over and spaced from the upper surface of the PCB plug section by a predetermined gap distance that allows insertion of the USB device into a standard female connector socket. With this arrangement, the plug substrate portion and the plug shell facilitate reliable and secure connection of the USB device to a standard female USB connection socket without requiring lead-based soldering of either the substrate or the plug shell to the PCB, thus facilitating the production of lead-free USB devices.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention relates to an improvement in USB connectors. The following description is presented to enable one of ordinary skill in the art to make and use the invention as provided in the context of a particular application and its requirements. As used herein, directional terms such as "upper", "upwards", "lower", "downward", "front", "rear", are intended to provide relative positions for purposes of description, and are not intended to designate an absolute frame of reference. In addition, the phrase "integrally connected" is used herein to describe the connective relationship between two portions of a single molded or machined structure, and is distinguished from the terms "connected" or "coupled" (i.e., without the modifier "integrally"), which indicates two separate structures that are joined by way of, for example, adhesive, fastener, clip or movable joint. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
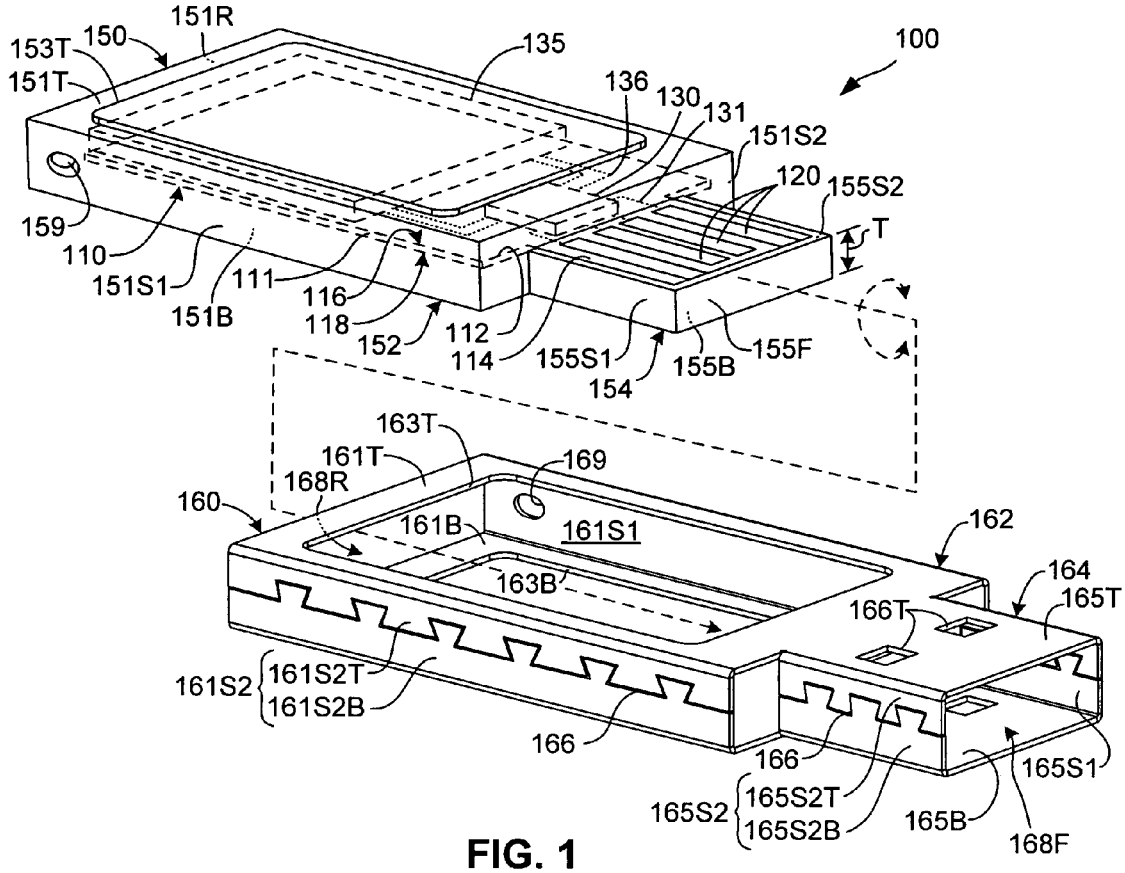
FIG. 1 is an exploded perspective view showing an exemplary USB device according to an embodiment of the present invention.
Figure 2:
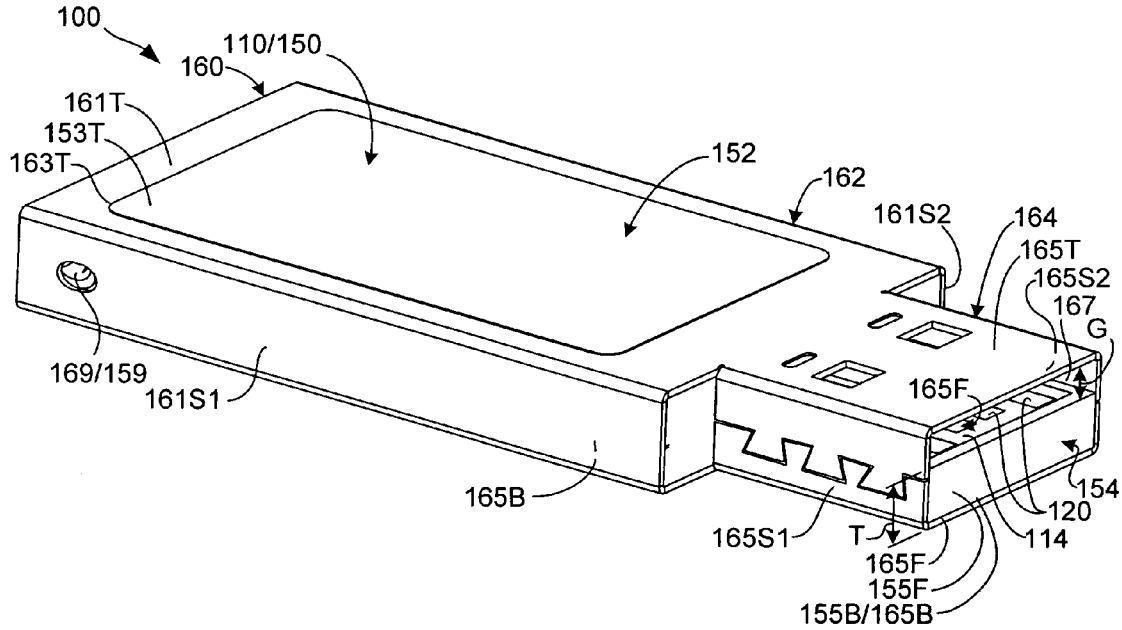
FIG. 2 is a perspective view showing the USB device of FIG. 1 in an assembled state.

FIG. 1 is an exploded perspective view showing a Universal-Serial-Bus (USB) device 100 according to a first embodiment of the present invention, and FIG. 2 is a perspective view showing USB device 100 in an assembled state. USB device 100 generally includes a printed circuit board assembly (PCBA) 110, a housing 150 that is fixedly mounted onto PCBA 110, and a case 160 that is mounted over housing 150.

Figure 3:
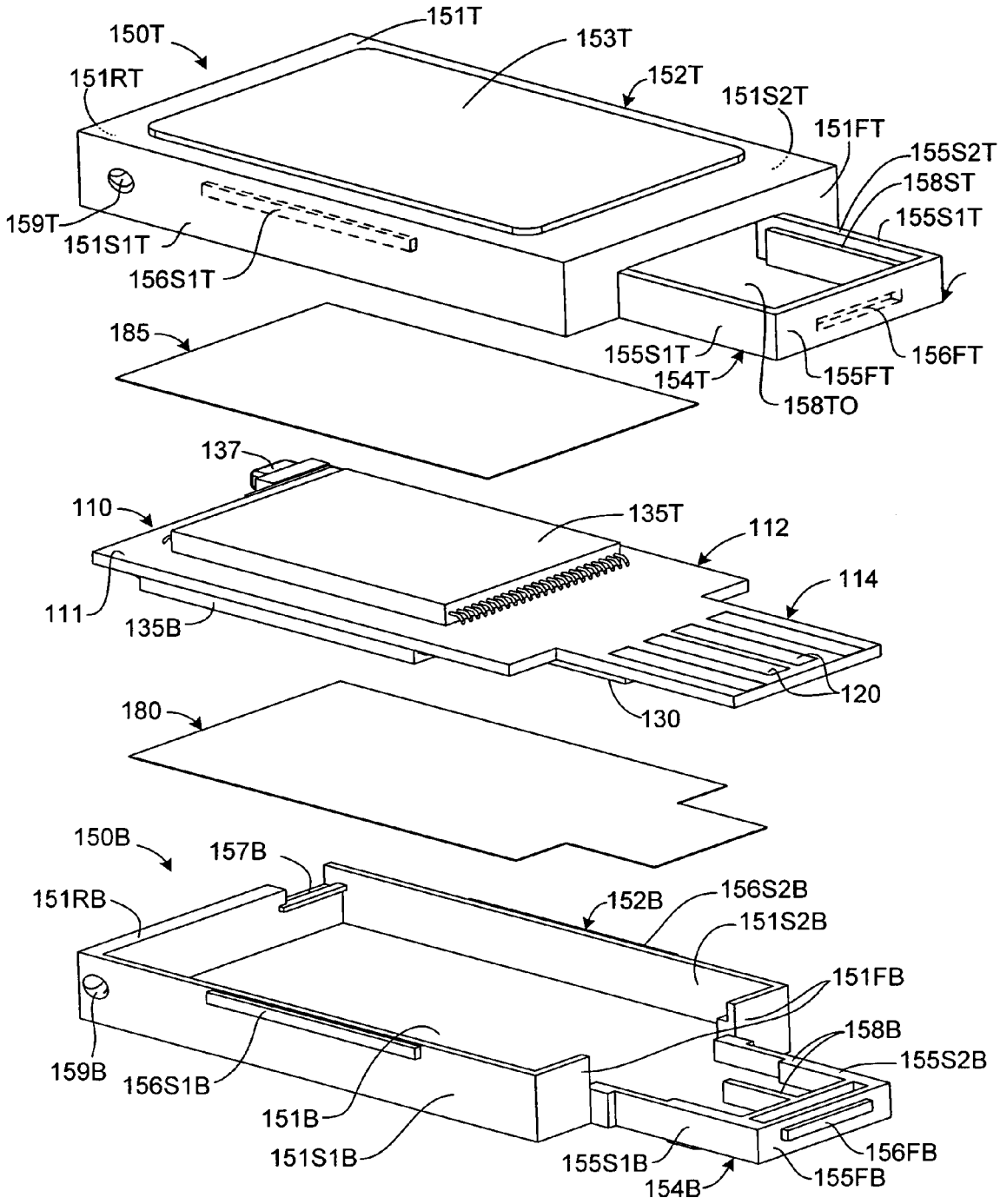
FIG. 3 is an exploded perspective view showing the housing and PCBA of the USB device of FIG. 1.

Referring to the upper portion of FIG. 1 and to FIG. 3, PCBA 110 includes a printed circuit board (PCB) 111 including a relatively wide PCB body section 112 and a relatively narrow PCB plug section 114 that extends from a front end of PCB body section 112. PCB 111 is a substantially flat substrate, and has opposing sides that are referred to below as upper surface 116 and lower surface 118. Formed on upper surface 116 in plug section 114 are four metal contacts 120. Metal contacts 120 are shaped and arranged in a pattern established by the USB specification. At least one control integrated circuit (IC) 130 and zero or more auxiliary ICs 135 (e.g., a flash memory device or an RF communication circuit) are mounted on at least one of upper surface 116 and lower surface 118. ICs 130 and 135 are electrically connected to each other and to metal contacts 120 by way of metal traces 131 and 136, respectively (a few traces are depicted in FIG. 1 in a simplified manner by dashed lines for illustrative purposes). PCB 111 is formed in accordance with known PCB manufacturing techniques such that metal contacts 120 and ICs 130 and 135 (as well as zero or more other circuit components, which are omitted for brevity) are electrically interconnected by a predefined network including conductive traces 131 and 136 and other conducting structures that are sandwiched between multiple layers of an insulating material (e.g., FR4) and adhesive.

Referring to FIG. 1, housing 150 generally includes a cover portion 152 mounted over PCB body section 112 such that ICs 130 and 135 are enclosed therein, and a plug substrate portion 154 integrally connected to and extending from cover portion 152 under PCB plug section 114. Cover portion 152 is a box-like structure including parallel upper and lower cover walls 151T and 151B and a peripheral side wall, formed by parallel side walls 151S1 and 151S2 and a rear wall 155F, that extends between upper and lower cover walls 151T and 151B. Plug substrate portion 154 includes a lower substrate wall 155B, parallel substrate side walls 155S1 and 155S2, and a front substrate wall 155F. PCB plug section 114 is coupled to plug substrate portion 154 in the manner described below such that plug substrate portion 154 covers lower surface 118 of PCB plug section 114, and the upper surface 116 of PCB plug section 114, which includes metal contacts 120, is exposed. In particular, metal contacts 120 face away from and are exposed above plug substrate portion 154.

Figure 15A:
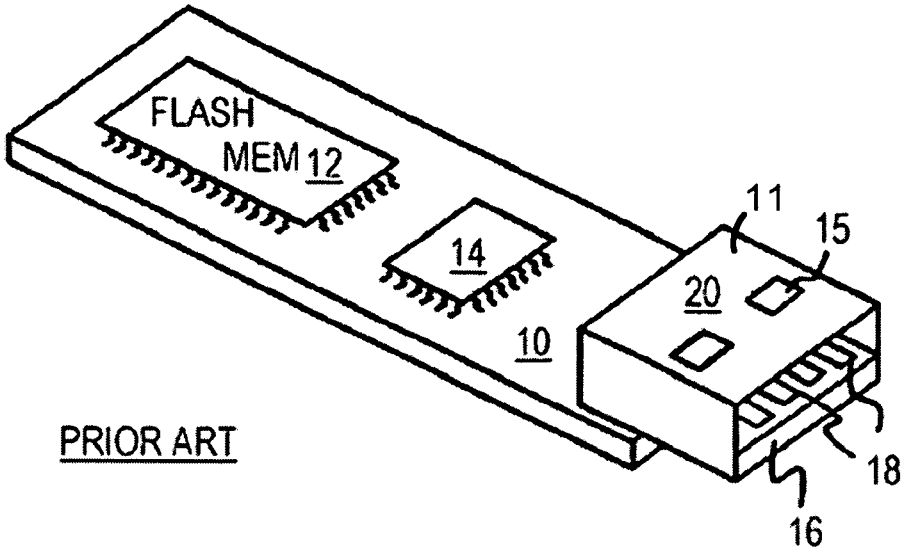
FIG. 15(A) shows a prior-art flash-memory card with a USB connector.
Figure 15B:
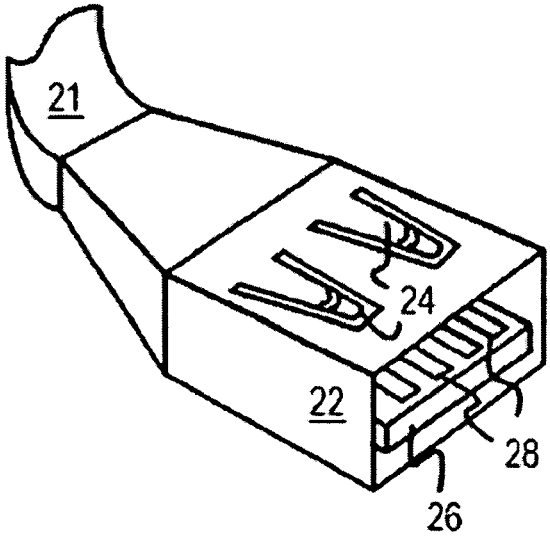
FIG. 15(B) shows a female USB connector.
Figure 16A:
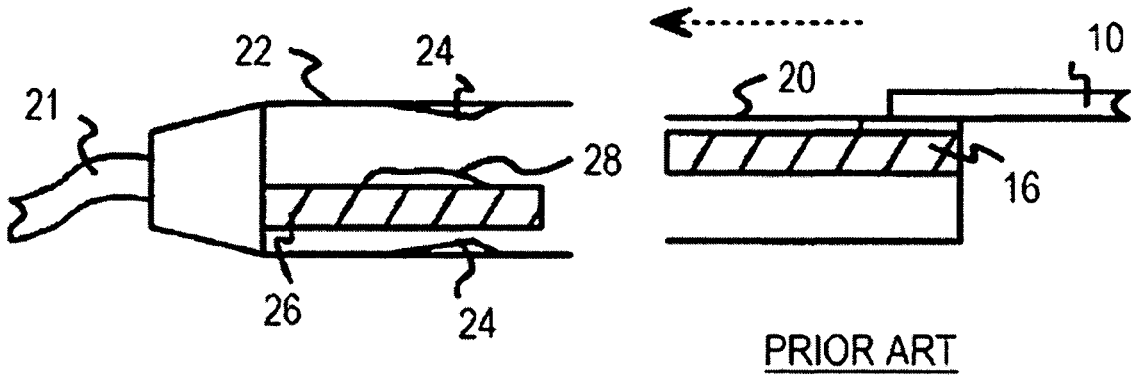
FIGS. 16(A) and 16(B) are cross-sections highlighting connections between male and female USB connectors.
Figure 16B:
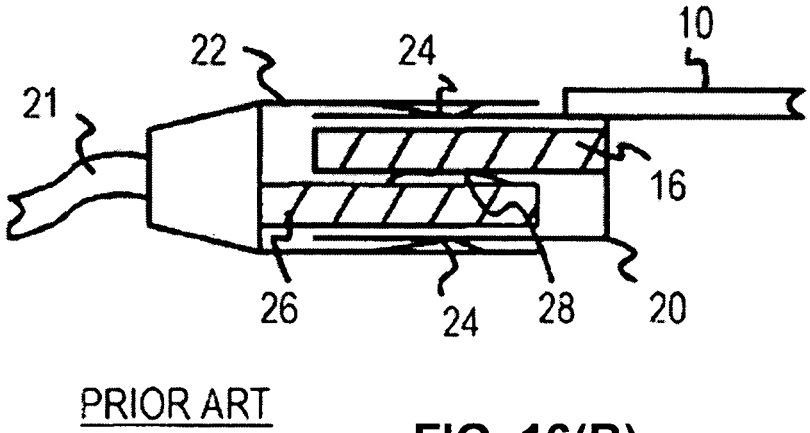
Figure 17:
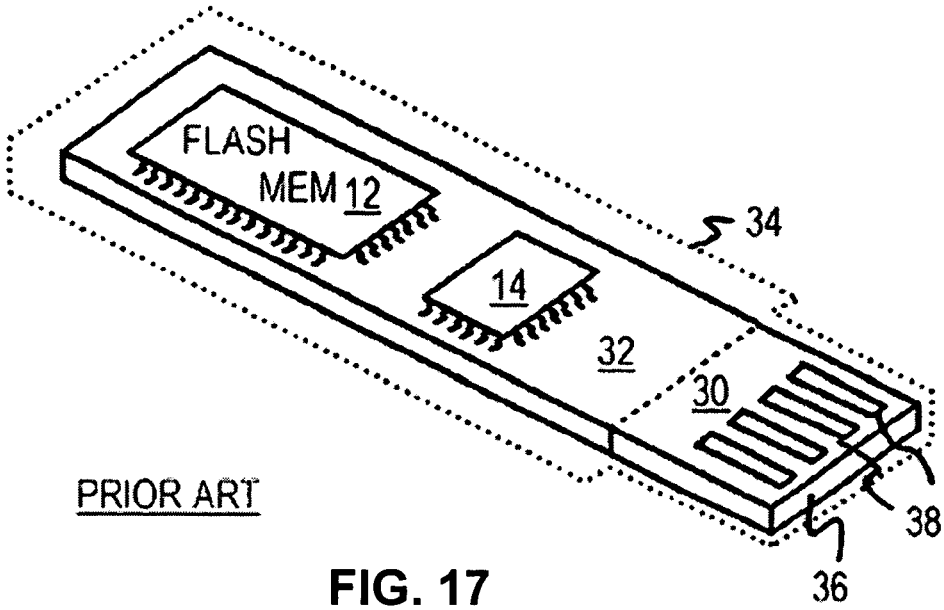
FIG. 17 shows a prior-art USB flash memory card using a USB connector.
Figure 18A:
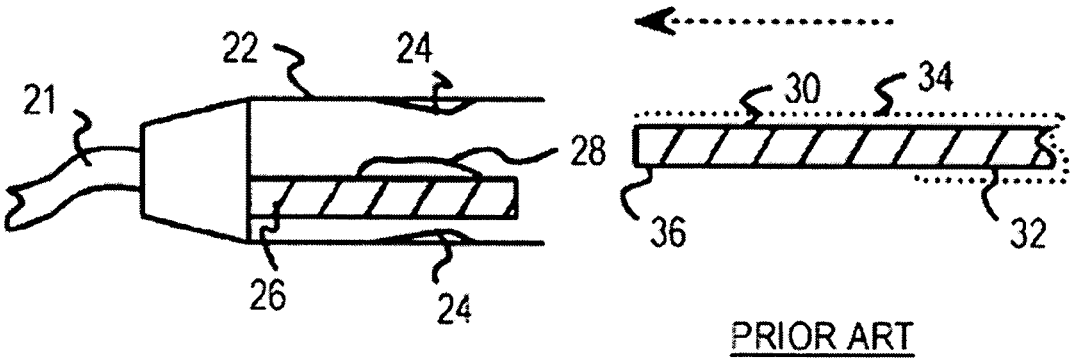
FIGS. 18(A) and 18(B) show cross-sections of the prior-art USB connector of FIG. 17 being inserted into a standard female USB connector socket.
Figure 18B:
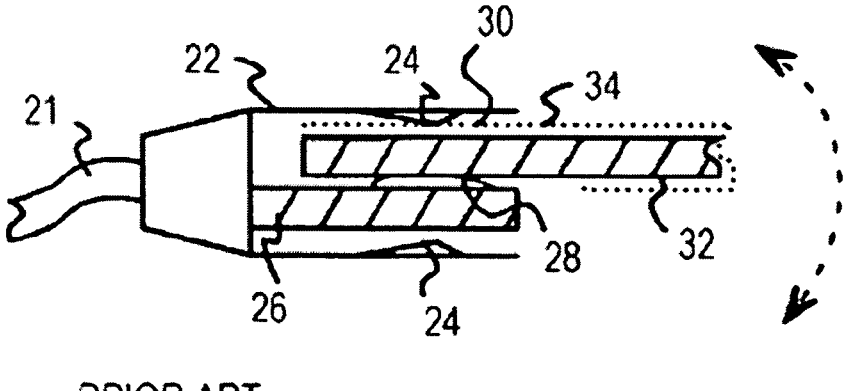

Case 160 includes a handle portion 162 and a plug shell 164 that is integrally connected at one to handle portion 162, and has a free end extending from handle portion 162. Handle portion 162 is a frame-like or box-like structure formed by parallel upper and lower handle walls 161T and 161B and parallel handle side walls 161S1 and 165S2 that define a rear opening 168F. Plug shell 164 includes parallel upper and lower shell walls 165T and 165B and parallel shell side walls 165S1 and 165S2 that define a front opening 168F. Optional locking depressions 166T are formed in upper plug shell wall 165T and are positioned to engage with metal springs 24 protruding from bottom wall 22A of standard female USB socket connector 22 (see, e.g., FIG. 15(B). In the present embodiment, upper shell wall 161T and upper handle wall 161T are co-planar, as are lower shell wall 161B and lower handle wall 161B, but a width distance separating shell side walls 165S1 and 165S2 is smaller than a width distance separating handle side walls 161S1 and 16112.

Figure 4A:
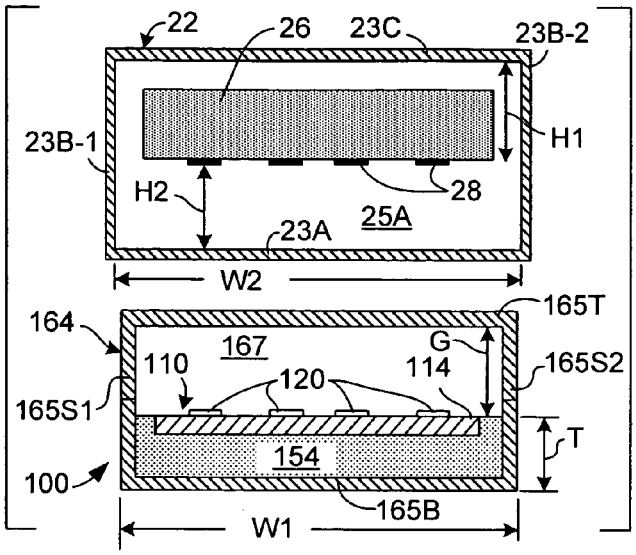
FIGS. 4(A) and 4(B) are cross-sectional side views showing a plug section of the USB device of FIG. 1 and a standard female USB connector socket.
Figure 4B:
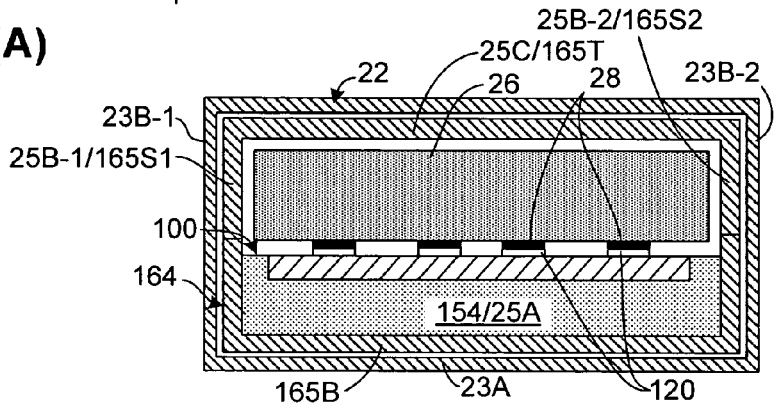

In accordance with an aspect of the present invention, as depicted in FIG. 2, plug substrate portion 154 and plug shell 164 collectively form a structure that is substantially identical to the plug shell of conventional male USB connectors without requiring soldering either structure to PCBA 110, as required in conventional male USB connectors, thereby facilitating the production of lead-free USB devices. That is, the assembly formed by PCBA 110 and housing 150 is inserted into or wrapped inside case 160 such that handle portion 162 is secured over housing cover portion 152, and such that plug shell 164 is positioned over PCB plug section 114 and plug substrate portion 154 in a manner similar to the arrangement associated with conventional male USB connector plugs. In particular, plug shell 164 is mounted over PCB plug section 114 and plug substrate portion 154 such that lower shell wall 165B contacts a lower surface of plug substrate portion 154 (i.e., bottom wall 155B), and upper shell wall 165T is positioned over and spaced from the upper surface of PCB plug section 114 (i.e., metal contacts 120) by a predetermined gap distance G. As indicated in FIG. 4(A), the gap distance G generally corresponds to a height H1 between metal contacts 28 and upper wall 23C of conventional standard female USB connector socket 22. Similarly, plug substrate portion 154 is formed such that the upper surface of PCB plug section 114 (i.e., metal contacts 120) are spaced a predetermined distance T from a lower surface of plug shell 164 (i.e., the lower surface of bottom wall 165B), which distance T corresponds to a height H2 between metal contacts 28 and lower wall 23A of conventional standard female USB connector socket 22. Finally, shell side walls 165S1 and 165S2 of plug shell 164 are spaced apart by a width W1 that generally corresponds to the width W2 associated with side walls 23B-1 and 23B-2 of standard female USB connector socket 22. Accordingly, as indicated in FIG. 4(B), when inserted into standard female USB connector socket 22, PCB plug section 114, plug substrate portion 154, and plug shell 164 are securely received in standard female USB connector socket 22 such that metal contacts 120 are reliably contacted with metal contacts 28. In particular, PCB plug section 114, plug substrate portion 154, and shell lower wall 165B of plug shell 164 are sized to be received in lower socket region 25A of female USB connector socket 22 with shell side walls 165S1 and 165S2 respectively received in side socket regions 25B-1 and 25B-2, and shell upper wall 165T received in upper socket region 25C. One benefit of integrally connecting plug shell 164 to case handle portion 162 (i.e., instead of to PCB 111, as in conventional structures) is that PCBA 110 can be produced using solder-free manufacturing techniques. That is, instead of using lead-based solder to secure plug shell 164 to PCB 111 or substrate 152, the present invention avoids the need for the use of hazardous lead solder by integrating plug shell 164 onto handle portion 162. In addition, ICs 130 and 135 are provided as surface mount components that don't contain lead in their pins/balls, thereby further enabling lead-free fabrication. Thus, because plug shell 164 is not directly or indirectly connected to PCBA 110, the present invention facilitates the production of PCBA 110 as a lead-free structure (i.e., produced without the use of lead-based solder).

In accordance with a specific embodiment of the present embodiment, housing 150 is mounted over PCBA 110 using the convenient snap-coupled arrangement depicted in FIG. 3. In particular, housing 150 generally includes a lower housing portion 150B and an upper housing portion 150T that snap-couple to each other over PCBA 110. Optional 180 and 185 are utilized to further secure lower housing portion 150B to upper housing portion 150T.

Lower housing portion 150B generally includes a lower cover portion 152B and a lower plug substrate portion 154B. Lower cover portion 152B includes a lower wall 151B and an inner peripheral wall formed by lower side walls 151S1B and 151S2B and lower rear wall 151RB extending upward from (perpendicular to) peripheral edges of lower wall 151B. Lower plug substrate portion 154B extends from a front wall 151FB of lower cover portion 152B, which defines a gap as shown in FIG. 3 to facilitate mounting of PCBA 110. Lower plug substrate portion 154B includes several support ribs 158B that extend upward from a lower plug wall 155B and, when mounted below PCBA 110, contact and help support plug section 114 of PCB 111. Support ribs 158B are surrounded on three sides by lower plug side walls 155S1B and 155S2B and lower plug front wall 155FB.

Upper housing portion 150T generally includes an upper cover portion 152T and an upper plug substrate portion 154T. Upper cover portion 152T includes upper wall 151T and an outer peripheral wall formed by upper side walls 151S1T and 151S2T and upper rear wall 151RT, which extend downward from (perpendicular to) peripheral edges of upper wall 151T. Upper plug substrate portion 154T extends from an upper front wall 151FT, and includes a peripheral shelf 158T that is formed on an inside surface of a peripheral wall formed by upper plug side walls 155S1T and 155S2T and upper plug front wall 155FT. Note that peripheral shelf 158T is exposed through an upper opening 158TO.

In accordance with an aspect of the present embodiment invention, lower housing portion 150B and upper housing portion 150T are fabricated such that the housing portions can be snap-coupled over PCBA 110 during the housing assembly process. In particular, the respective peripheral walls of housing portions 150B and 150T are constructed such that the inner peripheral wall of lower housing portion 150B can be inserted inside the outer peripheral wall of upper housing portion 150T, whereby the outside surfaces of the inner peripheral wall abut the inside surfaces of the outer peripheral wall. In addition, either a slot or a tab are provided on the outside surface of the inner peripheral walls, and a corresponding tab or slot are provided on the inside surfaces of the outer peripheral walls, wherein each tab is snap-coupled into a corresponding slot when upper housing portion 150T is mounted onto the lower housing portion 150B. In the present embodiment, the outside surfaces of selected lower walls (e.g., lower side wall 151S1B and lower plug front wall 151FB) includes a corresponding tab (e.g., tabs 156S1B and 156FB), and the inside surfaces of the outer peripheral walls (e.g., upper side wall 151S1T and upper plug front wall 155FT) of upper housing portion 150T defines a corresponding slot (e.g. 156S1T and 156FT) such that each tab is snap-coupled into a corresponding slot when upper housing portion 150T is mounted onto lower housing portion 150B. Note that the number of slots/tabs provided on each peripheral wall may be substantially arbitrarily selected, as well as the peripheral wall (inner or outer) on which the tabs/slots are provided. Note also that the various slots may either pass entirely through the corresponding wall, or as depicted by the dashed lines in the figures, be covered by an outer layer of the corresponding wall.

According to another aspect of the present invention, adhesive layers 180 and 185 are respectively provided between a lower PCBA surface (e.g., the surface of IC 135B facing downward from PCB 111) and lower cover wall 151B, and between an upper PCBA surface (e.g., the surface of IC 135T facing upward from PCB 111) and upper cover wall 151T in order to substantially permanently secure the housing formed by lower housing portion 150B and upper housing portion 150T over PCBA 110. Although the snap-coupling arrangement described above may be sufficient to prevent separation of housing portions 150B and 150T under normal operating conditions, the two housing portions may be separated during assembly. To prevent such disassembly, adhesive layers 180 and 185 serve to secure housing portions 150B and 150T together by way of PCBA 110. As mentioned above, PCBA 110 is formed using conventional PCB assembly procedures, and as such ICs 135B and 135T are rigidly secured to PCB 111. When secured to lower housing portion 150B by way of adhesive layer 180 and upper housing portion 150T by way of adhesive layer 185, PCBA 110 helps resist separation of the housing portions in response to an applied shearing force by resisting relative movement of the housing portions. In accordance with an embodiment of the present invention, adhesive layers 180 and 185 are pressure or heat activated, and mounted onto the inner surfaces of housing portions 150B and 150T before the assembly process is performed. In this manner, the snap-coupling procedure may be completed and reversed, if necessary, before permanent connection of housing portions 150B and 150T to PCBA 110 (e.g., in response to an applied pressure or heat). Alternatively, a standard adhesive may be used, but this may result in inadvertently gluing the housing portions together in a non-optimal position. In yet another embodiment, a liquid adhesive may be injected into the housing after the snap-coupling process to secure the PCBA to the cover plates.

Referring to the upper portion of FIG. 3, PCBA 110 also includes an optional light-pipe (light-generating device) 137 mounted onto upper surface 116 of PCB 111 adjacent to a back edge of PCB 111. Light-pipe 137 is controlled by a signal generated, for example by control IC 130 and transmitted over an associated conductive trace formed on PCB 111 according to known techniques. To facilitate viewing of light-pipe 137, the rear walls (e.g., rear bottom wall 151RB) are provided with suitable access openings (e.g., opening 157B) that, when PCBA 110 is properly mounted inside housing 150, is aligned with light-pipe 137 such that light-pipe 137 is visible. Note that case 160 includes rear opening 168R that facilitates viewing the activated/non-activated state of light-pipe 137, thereby enabling a user to, for example, confirm that USB device 100 is operably inserted into a female USB connector socket.

In accordance with another optional aspect of the present invention, USB device 100 may be provided with a through hole that passes through case 160 and housing 150 to facilitate, for example, the engagement of a key-chain structure. In particular, referring to FIG. 3, lower housing portion 150B includes a lower opening 159B and upper housing portion 150T includes an upper opening 159T that align to form a coincident opening 159 (FIG. 1) when the upper and lower housing portions are snap-coupled together as described above. Similarly, as shown in FIGS. 1 and 2, case 160 includes an associated opening 169 that coincides with opening 159 when housing 150 is, for example, inserted into case 160.

Figure 5A:
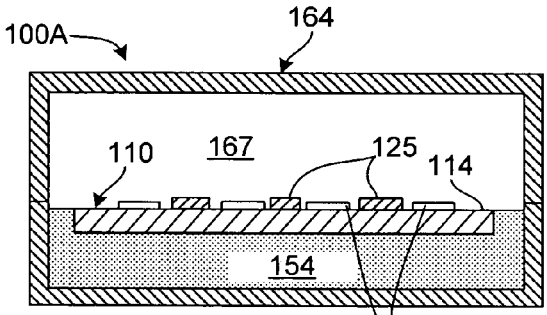
FIGS. 5(A) and 5(B) are cross-sectional side views showing a plug section of an alternative USB device according to another embodiment of the present invention.
Figure 5B:
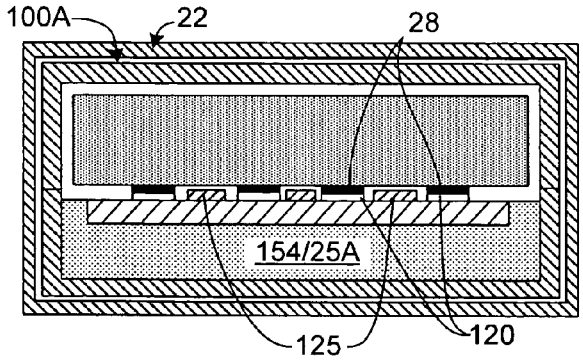

FIGS. 5(A) and 5(B) are simplified front views showing the plug portion of a USB device 100A according to a variation of the embodiment described above. Structures of USB device 100A that are identical to those of USB device 100 are identified with the same reference numerals, and will not be described in detail for sake of brevity. In accordance with another aspect, PCBA 110 includes elongated metal dividers 125 formed on the upper surface of plug section 114, with each metal divider 125 being located between an adjacent pair of the metal contacts 120. Metal dividers 125 increase the rigidity of the plug structure, thus further enhancing the secure engagement between the plug structure and standard female USB socket connector 22.

In accordance with various alternative embodiments disclosed herein, case 160 may be formed using a variety of materials and production methods, and take a variety of shapes. For example, referring again to FIG. 1, in accordance with one embodiment, case 160 is a folded sheet metal structure formed such that side wall 161S1 of handle portion 162 comprises a solid (unbroken) piece of sheet metal that is integrally connected between upper handle wall 161T and handle wall 161B. In contrast, opposing side wall 161S2 is formed in two parts: a lower section 161S2B that is integrally connected to and extends upward from lower handle wall 161B, and an upper section 161S2T that is integrally connected to and extends downward from the upper handle wall 161T, where upper section 161S2T and lower section 161S2B are joined by way of interlocking teeth 166 along a square-wave-like seam. Similarly, opposing side walls 165S1 and 165S2 of plug shell 164 are formed in two parts: lower sections 165S1B/165S2B that are integrally connected to and extend upward from lower shell wall 165B, and upper section 161S1T/161S2T that are integrally connected to and extend downward from upper shell wall 165T, where upper sections 161S1T/161S2T are joined by way of interlocking teeth 166 along a square-wave-like seam to lower sections 161S1B/161S2B. Note that shell 164 may be formed using a different material than handle portion 162. For example, shell 164 may be formed using metal that is integrally connected to a plastic handle portion 162 by way of known plastic molding techniques (i.e., by inserting metal plug shell into a designated section of the mold, and then causing molten plastic to form a portion of the plastic housing portion over the fixed end of the metal plug shell). Other possible case shapes, manufacturing methods, and materials are discussed with reference to the specific embodiments described below.

In accordance with another aspect of the present invention, case 160 is secured to the PCBA/housing assembly by way of cooperating locking structures formed on case 160 and housing 150. Referring to FIG. 1, housing 150 includes a raised panel 153T extending upward from upper housing wall 151T, and upper handle wall 161T of case 160 defines an upper panel opening 163T. Although not shown, a lower panel is provided on lower cover wall 151B that similarly engages with a lower panel opening 163B defined by lower handle wall 161B. As indicated in FIG. 2, when housing 150 is slid or otherwise mounted inside casing 160, raised panel 153T protrudes through upper panel opening 163T (and the lower panel similarly protrudes downward through lower panel opening 163B), thereby preventing housing 150 from slidably disengaging from case 160. Those skilled in the art will recognize that other connection structures may also be employed, some of which are described below.

According to another aspect of the present invention, another benefit of exposing panel 153B and 153T is the superior tactile characteristic provided by plastic over the sheet metal of case 160. That is, even if panels panel 153B and 153T did not protrude through and lock with panel openings 163B and 163T, respectively, the disclosed arrangement would allow a user to grasp USB device 100 by way of plastic panels 153B and 153T, which provides a softer and warmer sensation than the sheet metal of case 160.

Figure 6:
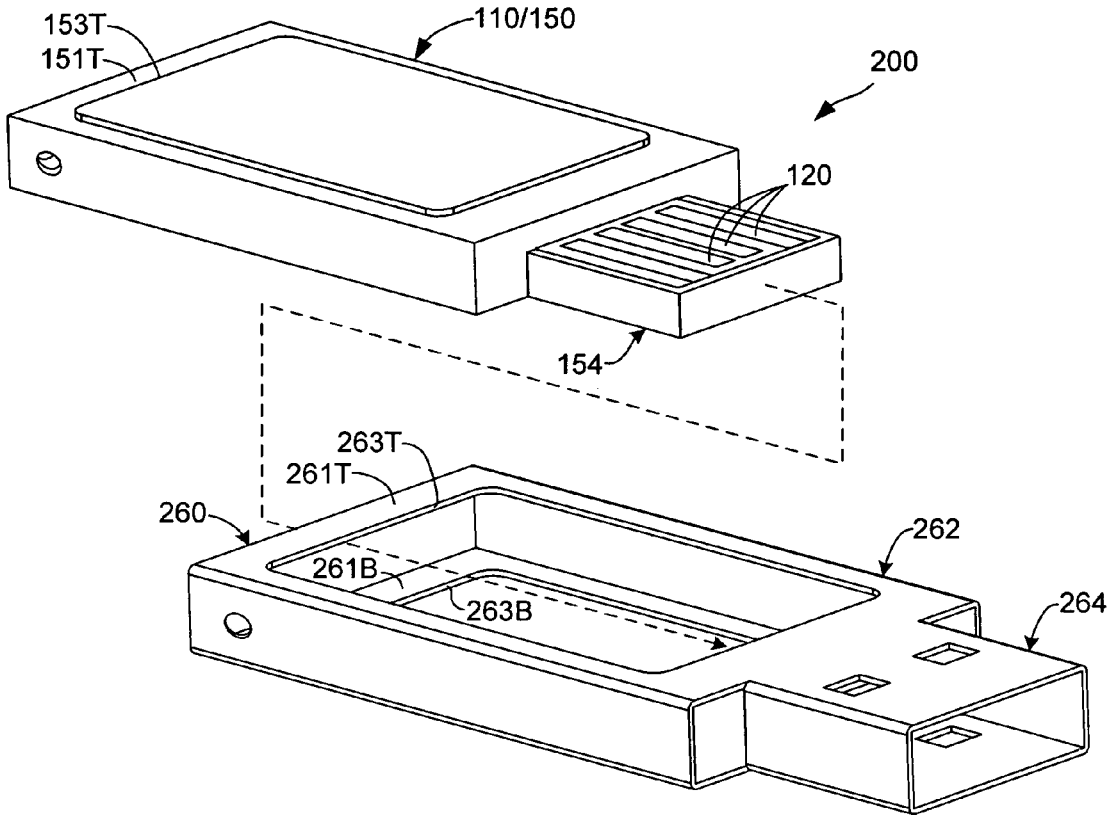
FIG. 6 is an exploded perspective view showing an exemplary USB device according to another embodiment of the present invention.
Figure 7:
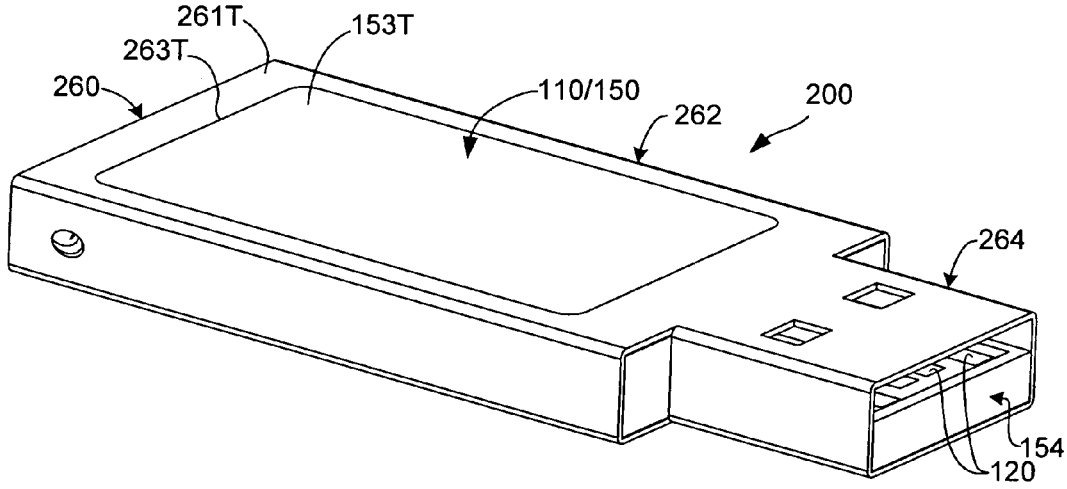
FIG. 7 is a perspective view showing the USB device of FIG. 6 in an assembled state.

FIG. 6 is an exploded perspective view showing a Universal-Serial-Bus (USB) device 200 according to another embodiment of the present invention, and FIG. 7 is a perspective view showing USB device 200 in an assembled state. Structures of USB device 200 that are identical or similar to those of USB device 100 are identified with the same or similar reference numerals, and will not be described in detail for sake of brevity. USB device 200 utilizes the same assembly formed by PCBA 110 and housing 150 (both described above) and a case 260 that is mounted over housing 150 in a manner similar to the above embodiment. Further, case 260 is similar to case 160 in that it includes a plug shell section 264 that is integrally connected to a handle section 262, and mounted over housing 150 such that plug substrate portion 154 and metal contacts 120 are exposed. Case 260 differs from case 160 (discussed above) in that case 260 comprises molded metal (e.g., stainless steel), and therefore does not exhibit the seams present in sheet metal case 160. Similar to case 160, case 260 includes upper and lower handle walls 261T and 261B that respectively define upper and lower panel openings 263T and 263B that receive raised panels 153T and 153B such that the panels extend into and/or exposed through the panel openings. Note that to facilitate insertion of housing 150, case 160 preferably has a wall thickness of 0.3 mm or less.

Figure 8:
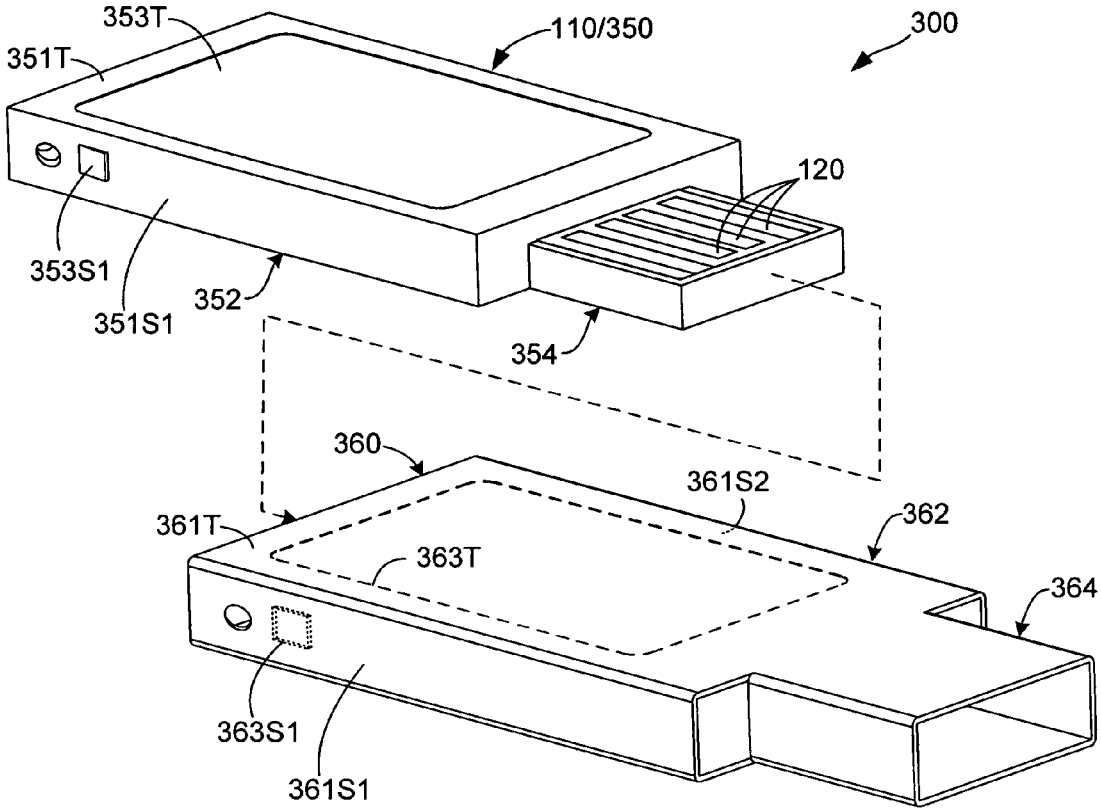
FIG. 8 is an exploded perspective view showing an exemplary USB device according to another embodiment of the present invention.
Figure 9:
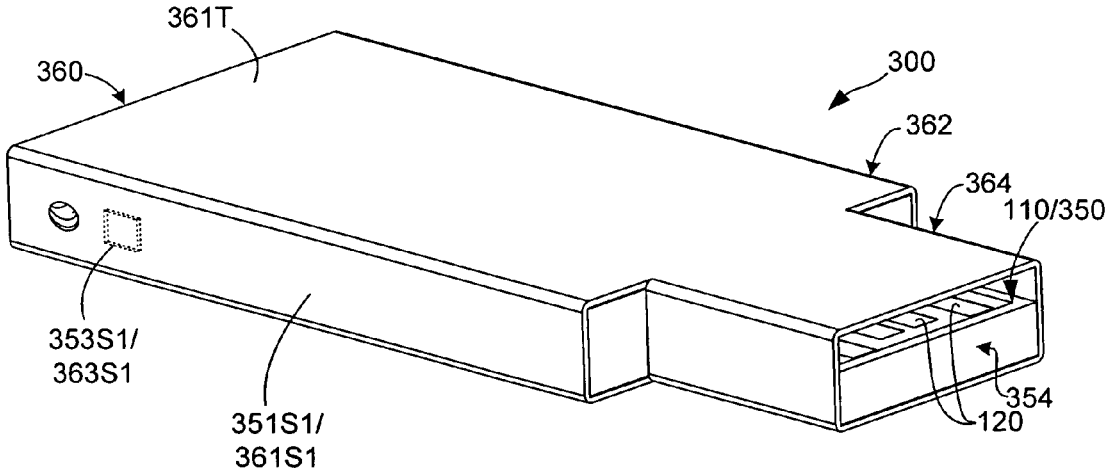
FIG. 9 is a perspective view showing the USB device of FIG. 8 in an assembled state.

FIG. 8 is an exploded perspective view showing a Universal-Serial-Bus (USB) device 300 according to another embodiment of the present invention, and FIG. 9 is a perspective view showing USB device 300 in an assembled state. Structures of USB device 300 that are identical or similar to those of USB device 100 are identified with the same or similar reference numerals, and will not be described in detail for sake of brevity. USB device 300 utilizes the same PCBA 110 described above, but uses a somewhat different housing 350 and a different case 360 that is mounted over housing 350 in a manner similar to the above embodiment. Housing 350 is similar to housing 150 in that it includes a plug substrate portion 354 that is integrally connected to a cover portion 352, and case 360 is similar to case 160 in that it includes a plug shell section 364 that is integrally connected to a handle section 362, and mounted over housing 350 such that plug substrate portion 354 and metal contacts 120 are exposed. The present embodiment is distinguished over previous embodiments in that case 260 is a hard molded plastic (e.g., PVC), as distinguished from the relatively soft plastic (e.g., ABS) that is used to form housing 150. Because case 260 is formed from plastic, there is no reason to expose portions of housing 150, and thus upper handle wall 361T includes a solid sheet of plastic (i.e., no panel opening). To facilitate the housing-to-case locking process, case 360 includes (first) locking structures (e.g., depression 363S1 on side wall 361S1 and/or raised section 363T on upper wall 361T), and housing 350 is provided with corresponding (second) locking structures (e.g., protrusion 353S1 on side wall 351S1 and/or depression 353T on upper wall 351T). When housing 350 is slid into case 360, as shown in FIG. 9, these locking structures engage to prevent unwanted disengagement. Note that, even though case 360 is plastic, it may be desirable to expose the softer plastic of housing 350, and thus it may be desirable to utilize the panel locking structure described above. Further, it may be desirable to form plug shell 364 using sheet metal instead of hard plastic in the manner described above.

Figure 10:
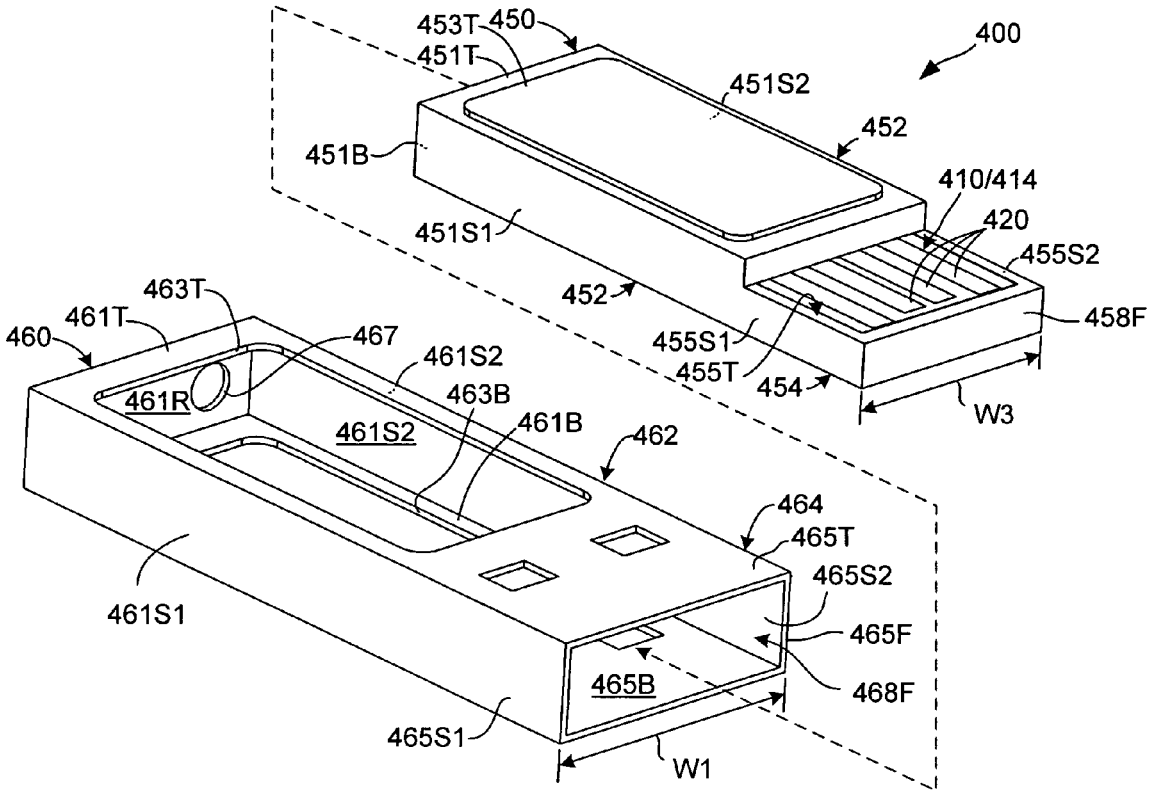
FIG. 10 is an exploded perspective view showing an exemplary USB device according to another embodiment of the present invention.
Figure 11:
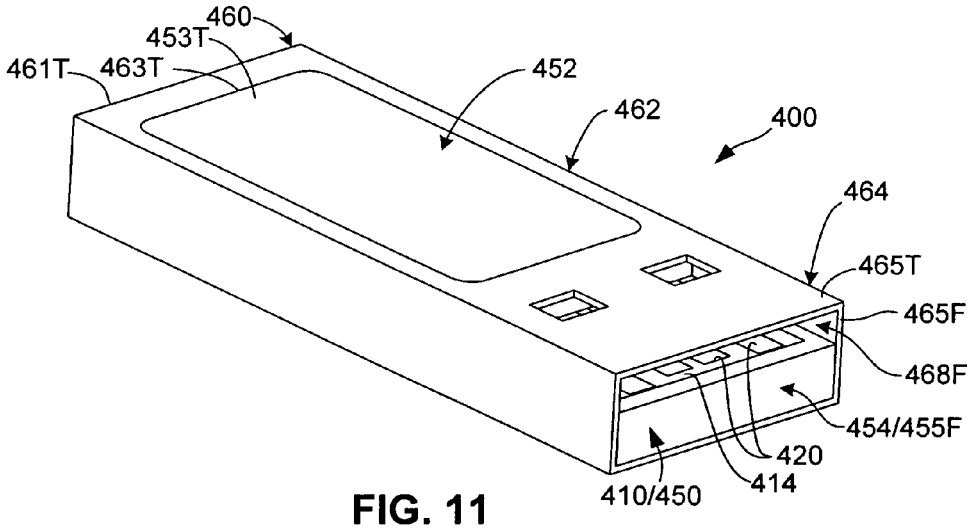
FIG. 11 is a perspective view showing the USB device of FIG. 10 in an assembled state.

FIG. 10 is an exploded perspective view showing a Universal-Serial-Bus (USB) device 400 according to another embodiment of the present invention, and FIG. 11 is a perspective view showing USB device 400 in an assembled state. Structures of USB device 400 that are similar to those of USB device 100 are identified with similar reference numerals (i.e., 4xx in place of 1xx), and will not be described in detail for sake of brevity.

As indicated in FIGS. 10 and 11, USB device 400 includes a PCBA 410 and housing 450 that are received in a case 460 characterized by having side walls 461S1 and 461S2 of a handle portion 462 are coplanar with corresponding side walls 465S1 and 465S2 of a plug shell 464 such that USB device 400 defines a uniform case width W1 extending from a front edge 465F of plug shell 464 to a rear wall 465B of handle portion 462. Similar to previous embodiments, upper and lower walls 461T and 461B of handle portion 462 are coplanar with corresponding upper and lower walls 465T and 465B of plug shell 464. Similarly, housing 450 includes a cover portion 452 having side walls 451S1 and 451S2 that are coplanar with corresponding side walls 455S1 and 455S2 of a plug substrate portion 454, both defining a width W3 that is slightly smaller than the uniform case width W1 to facilitate slidable insertion of housing 450 (and PCBA 410) through a front opening 468F defined by plug shell 464. The assembled USB device 400 (shown in FIG. 12) is narrower than the "wide handle" embodiments described above, and thus smaller and easier to carry. Note that an upper wall 455T of plug substrate portion 454 is offset from an upper wall 451T of cover section 452, thereby providing the required gap 468F between upper wall 465T and PCB plug section 414 to facilitate access to metal contacts 420 during operation. Note also that a length of housing 450 is selected such that front wall 455F of plug substrate portion 454 substantially aligns with front edge 465F of plug shell 464.

Figure 12:
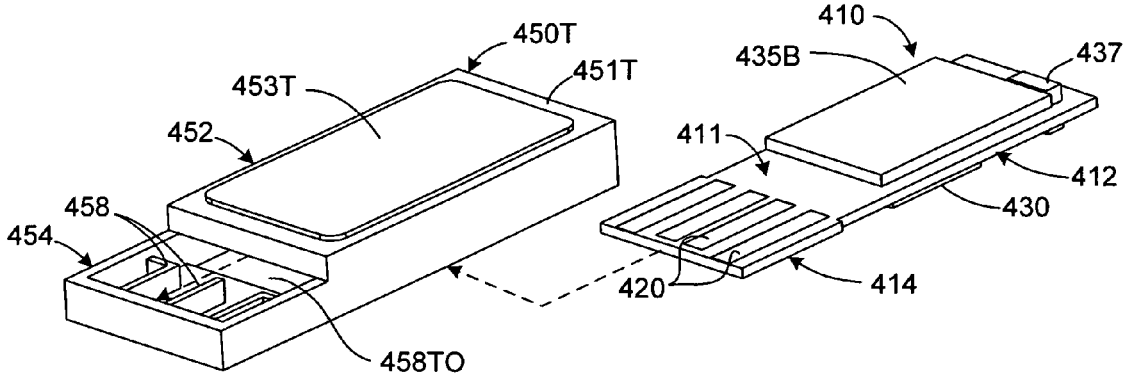
FIG. 12 is an exploded perspective view showing a housing and a PCB of the USB device of FIG. 10.
Figure 13A:
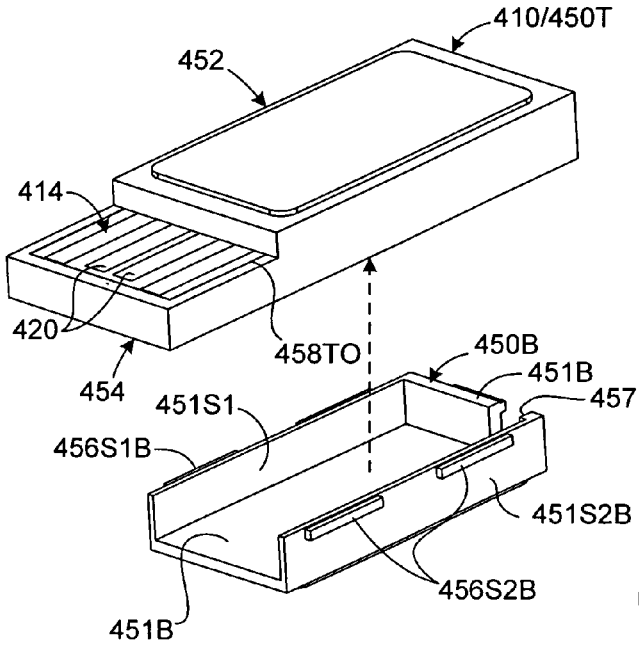
FIGS. 13(A) and 13(B) are an exploded top and bottom perspective views, respectively, showing a case and housing and a PCB of the USB device of FIG. 10.
Figure 13B:
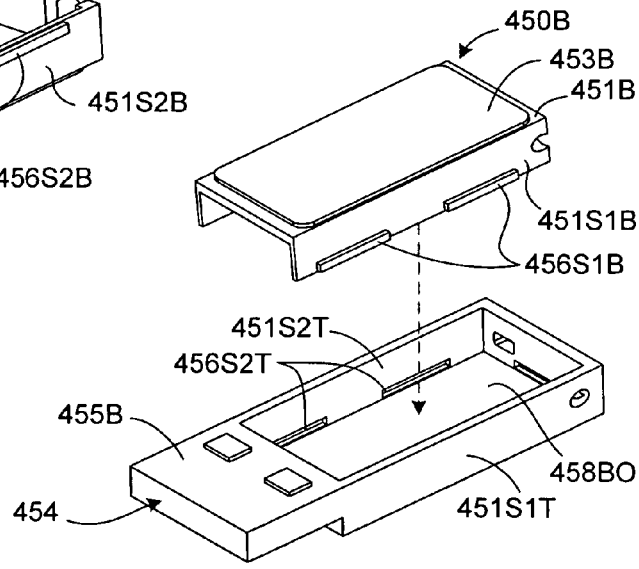

FIGS. 12, 13(A) and 13(B) depict PCBA 410 and housing 450 in additional detail. Referring to FIG. 12, PCBA 410 is similar to PCBA 110 (discussed above) in that PCBA 410 includes a PCB 411 having a body section 412 including ICs 430 and 435, and a PCB plug section 414 including metal contacts 420. Note that PCBA 410 differs from PCBA 110 in that IC 435 comprises a relatively narrow flash EEPROM device (e.g., using BGA flash chips or die-mountings produced by Samsung Electronics Co., Ltd., Suwon-Si, South Korea) in comparison to the "conventional" flash EEPROM devices utilized in the "wide handle" embodiments described above. As indicated in FIGS. 12 and 13(B), housing 450 includes an upper housing portion 450T that defines an upper housing opening 458TO defined over plug substrate portion 454 (FIG. 12), and a lower housing opening 458BO defined under cover section 452 (FIG. 13(B)). As indicated by the arrow in FIG. 12, a front edge of PCBA 410 is inserted through lower opening 458BO and into upper opening 458TO such that PCB plug section 414 is supported on ribs 458 provided in plug substrate portion 454, and body section 412 is received inside cover portion 452. Next, as indicated in FIGS. 13(A) and 13(B), a lower housing portion 450B is mounted onto upper housing portion 450 to cover the body portion of the PCBA. In the present embodiment, lower housing portion 450B includes a lower wall 451B, and a peripheral wall including side walls 451S1 and 451S2 and a back wall 451B extending upward from lower wall 451B. Tabs (e.g., tabs 456S1B and 456S2B) are formed on the peripheral wall (e.g., side walls 451S1B and 451S2B) that are coupled to corresponding slots (e.g., slots 456S2T) formed on corresponding walls of upper housing portion 450T (e.g., side wall 451S2T). Note that, upon completion of the assembly process, lower wall 451B of lower housing portion 450B is substantially coplanar with lower wall 455B of plug substrate portion 454.

Referring again to FIGS. 10 and 11, the assembly formed by PCBA 410 and housing 450 is then inserted through front opening 468F of case 460 until back wall 451B of housing 450 either abuts or is positioned adjacent to rear wall 461R of case 460. Similar to USB device 100 (described above), locking panel structures 453T and 453B are respectively provided on upper cover wall 451T and lower cover wall 451B that extend into panel openings 463T and 463B defined in upper handle wall 461T and lower handle wall 461B of case 460. To facilitate viewing of a light producing element mounted on PCBA 410 (e.g., light-pipe 437, shown in FIG. 12), housing 450 is provided with corresponding openings (e.g., light-pipe opening 457, shown in FIG. 13(A)) that align with a light pipe opening 467 provided in back wall 461R of case 460 (shown in FIG. 10).

The various USB device structures described herein may be modified using appropriate ICs (e.g., ICs 130 and 135) to serve as convenient external storage for, for example, MP3 players (i.e., media storage for music), digital cameras, and mobile phones.

Figure 14:
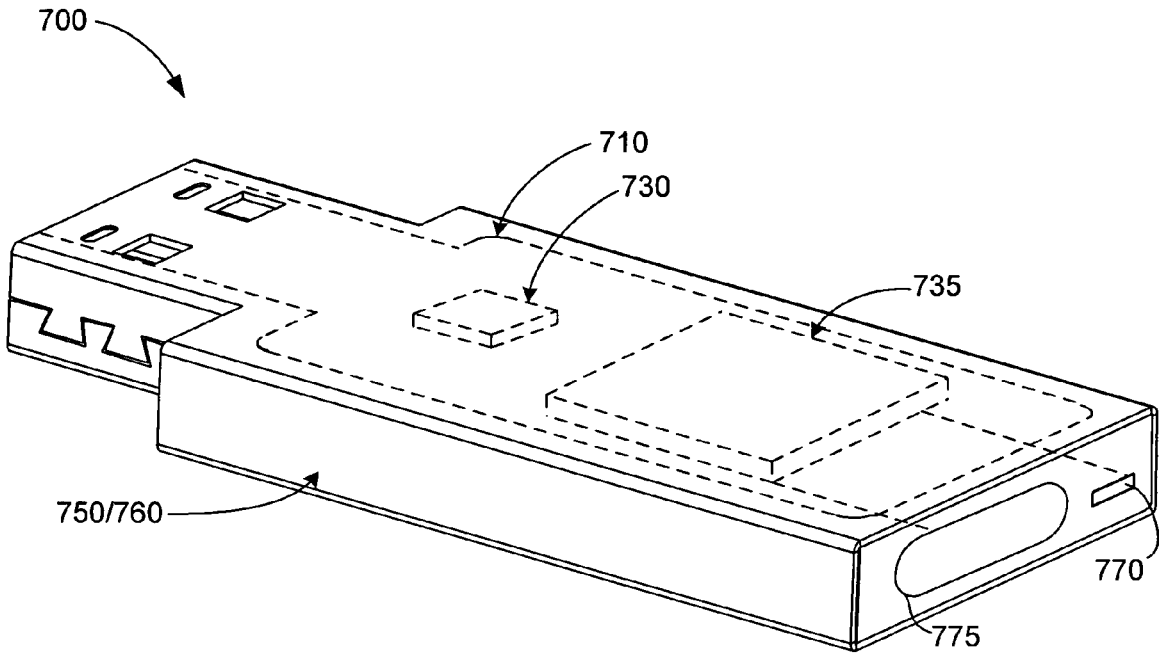
FIG. 14 is a perspective view showing a wireless communication-type USB device produced in accordance with another embodiment of the present invention.

In yet another embodiment, the disclosed USB device structures may be utilized to facilitate wireless communications. In this case, a USB device (e.g., Bluetooth USB adapter 700 shown in FIG. 14) may be plugged into the USB port of a host device, and may include a wireless communication device 735 that generates wireless signals emitted from a transceiver antenna 775, which may be provided on a back side of housing 750 to maximize the effect of signal transmission. Wireless communication device 735 communicates with a host (e.g., a computer) via USB control IC 730, and includes a Bluetooth controller, a radio frequency (RF) transceiver, a baseband controller, memory (e.g., EEPROM), a voltage regulator, a crystal, and a control circuit for controlling LED 770. These circuits may be combined together, along with passive circuits (e.g., resistors, capacitors and inductors) in a single chip, as depicted, or formed on one or more separate chips that are mounted on PCB 710 and enclosed by housing 750 and associated case 760 that are connected together in the manner described above. Such an arrangement would facilitate communication between the host and a wireless communication device, such as a BlueTooth-enabled device. Bluetooth is a wireless technology that enables any electrical device to wirelessly communicate in the 2.4 GHz frequency band. It allows devices such as mobile phones, headsets, PDA's and computers to communicate and send data to each other without the need for wires or cables to link to devices together. It has been specifically designed as a low cost, low power, radio technology, which is particularly suited to the short range Personal Area Network (PAN) application. By plugging Bluetooth USB adapter 700 into the USB port, the Bluetooth USB adapter enables a non-Bluetooth electrical device (i.e., the host) to communicate with Bluetooth enabled devices. One specific wireless application may be a BlueTooth mouse device, which are used today for cursor pointing. Another application example is allowing computer user doing two-way communication to Bluetooth-wireless equipped mobile phones, PDA, keyboard, printer, digital camera, and MP3 player. Other applications may include wireless headsets. Yet another application may include enabling BlueTooth wireless connections inside an automobile to facilitate "hands free" operation of a mobile phone. Of course, other wireless communication protocols, such as IrDA infrared transmitting devices, may also be utilized in conjunction with USB devices of the present invention.

In addition to the specific housing arrangements described above with reference to the various disclosed embodiments, those skilled the art will recognize that other housing structures and connection methods may be used. For example, instead of a tab/slot snap-together arrangement, the upper and lower housing portions may be connected by way of ultrasonic welding. Accordingly, unless otherwise specified, the appended claims are not intended to be limited to the disclosed housing arrangements.

Although the present invention has been described with respect to certain specific embodiments, it will be clear to those skilled in the art that the inventive features of the present invention are applicable to other embodiments as well, all of which are intended to fall within the scope of the present invention.

The invention claimed is:

1. A Universal-Serial-Bus (USB) device comprising:

a printed circuit board assembly (PCBA) including:

a printed circuit board (PCB) having opposing upper and lower surfaces and including a PCB body section and a PCB plug section, a plurality of metal contacts disposed on the upper surface of the PCB plug section, and at least one integrated circuit (IC) mounted on the PCB body section, the IC including means for processing USB signals transmitted to the plurality of metal contacts; and a plastic housing including a cover portion mounted over the PCB body section such that the IC is enclosed inside the cover portion, and a plug substrate portion integrally connected to and extending from the cover portion, wherein the PCB plug section is fixedly attached to the plug substrate portion such that the plug substrate portion covers the lower surface of the PCB plug section, and the upper surface of the PCB plug section is exposed above the plug substrate portion; and a case including a handle portion fixedly secured around the cover portion of the plastic housing, and a plug shell integrally connected to and extending from the handle portion such that a lower shell wall of the plug shell contacts a lower surface of the plug substrate portion and an upper shell wall of the plug shell is positioned over and spaced from the upper surface of the PCB plug section by a predetermined gap distance.

2. The USB device of claim 1, wherein the PCBA comprises a lead-free structure.

3. The USB device of claim 1, wherein the housing comprises:

a lower housing portion including a lower cover portion having a lower cover wall and a first peripheral wall extending perpendicular to the cover plate;

a plurality of tabs formed on an outside surface of the first peripheral wall; and an upper housing portion including a top cover wall and a second peripheral wall extending perpendicular to the top plate, wherein an inside surface of the second peripheral wall defines a plurality of slots arranged such that, when the upper housing portion is mounted over the lower housing portion, each of the tabs formed on the first peripheral wall engages a corresponding slot formed on the second peripheral wall.

4. The USB device of claim 3, further comprising a first adhesive layer disposed between a lower surface of the PCBA and the lower cover wall, and a second adhesive layer disposed between the upper surface of the PCBA and the upper cover wall.

5. The USB device of claim 1, further comprising a light-producing device mounted on the upper surface of the PCB, wherein a peripheral wall of the housing defines an opening aligned such that the light-producing device is visible through the opening.

6. The USB device of claim 1, wherein both the case and the housing define coincident holes for receiving a key chain therein.

7. The USB device of claim 1, wherein the PCB further comprises metal dividers formed on the upper surface of the PCB, each of the metal dividers being located between an adjacent pair of the metal contacts.

8. The USB device of claim 1, wherein the case comprises folded sheet metal formed such that the handle portion includes a first side wall comprising a solid piece of said sheet metal that is connected between an upper handle wall and a lower handle wall, and a second side wall including a lower section extending upward from the lower handle wall, and an upper section extending downward from the upper handle wall.

9. The USB device of claim 8, wherein the housing includes an upper housing wall and an upper raised panel extending upward from the upper housing wall, wherein the upper handle wall of the case defines an upper panel opening, and wherein the housing is secured inside the case such that the upper raised panel is exposed through the upper panel opening.

10. The USB device of claim 1, wherein the plug shell further comprises first and second side shell walls extending between the upper shell wall and the lower shell wall, wherein at least one of the first and second side shell walls includes an upper section integrally connected to the upper shell wall and a lower section integrally connected to the lower shell wall.

11. The USB device of claim 1, wherein the case comprises metal, wherein the housing includes an upper housing wall and an upper raised panel extending upward from the upper housing wall, wherein the upper handle wall of the case defines an upper opening, and wherein the housing is secured inside the case such that the upper raised panel is exposed through the upper opening.

12. The USB device of claim 1, wherein the case comprises plastic and defines a first locking structure disposed on at least one wall of the handle portion, and wherein the housing includes a second locking structure engaged with the first locking structure of the case such that the housing is secured to the case by the engaged first and second locking structures.

13. The USB device of claim 1, wherein side walls of the handle portion are coplanar with corresponding side walls of the plug shell such that the USB device defines a uniform case width extending from a front edge of the plug shell to a rear edge of the handle portion.

14. The USB device of claim 13, wherein side walls of the cover portion are coplanar with corresponding side walls of the plug substrate portion and define a width that is smaller than the uniform case width, whereby the plastic housing is slibably received through an opening defined by the plug shell.

15. The USB device of claim 12, wherein the housing includes an upper housing wall and an upper raised panel extending upward from the upper housing wall, wherein the upper handle wall of the case defines an upper panel opening, and wherein the housing is secured inside the case such that the upper raised panel is extends into the upper panel opening.

16. The low-profile USB device of claim 1, wherein the ICs include a wireless communication transmission device.

* * * * *